US007713101B2

(12) United States Patent
Oka et al.

(10) Patent No.: US 7,713,101 B2
(45) Date of Patent: May 11, 2010

(54) MALE TERMINAL HAVING A U-SHAPED CROSS SECTION

(75) Inventors: Taichi Oka, Hitachi (JP); Kenji Nakajima, Hitachi (JP); Hideaki Takehara, Hitachi (JP); Michiaki Shimizu, Hitachi (JP); Shinji Ito, Hitachi (JP); Toru Sumi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 12/479,021

(22) Filed: Jun. 5, 2009

(65) Prior Publication Data

US 2009/0247024 A1 Oct. 1, 2009

Related U.S. Application Data

(62) Division of application No. 11/635,766, filed on Dec. 8, 2006, now Pat. No. 7,594,832.

(30) Foreign Application Priority Data

Dec. 28, 2005 (JP) ..... 2005-380303
Dec. 28, 2005 (JP) ..... 2005-380304

(51) Int. Cl.
*H01R 9/24* (2006.01)

(52) U.S. Cl. ..... 439/884

(58) Field of Classification Search ..... 439/884, 439/886, 825, 936, 699.1
See application file for complete search history.

(56) References Cited

U.S. PATENT DOCUMENTS 2,021,701 A 11/1935 Smith
2,983,898 A 5/1961 Kalmar et al.
3,288,915 A 11/1966 Hatfield et al.
3,388,367 A 6/1968 Brown
3,634,811 A 1/1972 Teagno et al.
3,760,340 A 9/1973 Friend
4,105,276 A 8/1978 Miller
4,416,504 A 11/1983 Sochor
4,626,061 A 12/1986 Patton
4,696,530 A 9/1987 Vandame
5,609,505 A * 3/1997 Endo et al. ..... 439/886
5,833,500 A 11/1998 Mahon et al.

(Continued)

FOREIGN PATENT DOCUMENTS

JP 7-51739 Y2 11/1995

(Continued)

*Primary Examiner*—Chandrika Prasad
(74) *Attorney, Agent, or Firm*—Foley & Lardner LLP

(57) ABSTRACT

A male terminal 10 has a wire connecting portion 13 at one end to be connected to an electric wire, and an inserting contact portion 12 at another end to be inserted into a female terminal 30. A plate member of the inserting contact portion 12 is bent to have a U-shape cross section. The female terminal 30 has a terminal energizing portion 31 composed of a high conductivity material having a frame structure for accommodating the male terminal 10, a terminal box 32 composed of a material having a strength higher than that of the high conductivity material of the terminal energizing portion 31 for covering the terminal energizing portion 31, and a spring 33 located within the terminal energizing portion 31 for fixing the male terminal 10. The spring 33 is formed integrally with the terminal box 32.

17 Claims, 7 Drawing Sheets

U.S. PATENT DOCUMENTS

| | | | |
|---|---|---|---|
| 5,846,098 | A | 12/1998 | Shiga et al. |
| 5,911,605 | A | 6/1999 | Wooldridge et al. |
| 6,203,385 | B1 | 3/2001 | Sato et al. |
| 6,244,910 | B1 | 6/2001 | Grubbs |
| 6,283,803 | B1 | 9/2001 | Sato et al. |
| 6,402,575 | B1 | 6/2002 | Suzuki |
| 6,638,117 | B2 | 10/2003 | Murakami et al. |
| 6,659,813 | B2 | 12/2003 | Sai |
| 7,090,547 | B2 | 8/2006 | Machida et al. |
| 7,094,114 | B2 | 8/2006 | Kurimoto |
| 2003/0008548 | A1 | 1/2003 | Ueda et al. |
| 2004/0009714 | A1 | 1/2004 | Endo et al. |
| 2004/0209529 | A1 | 10/2004 | Kuroda et al. |
| 2005/0032440 | A1 | 2/2005 | Kurimoto |

FOREIGN PATENT DOCUMENTS

| | | | |
|---|---|---|---|
| JP | 2878429 | B2 | 1/1999 |
| JP | 11-233182 | A | 8/1999 |
| JP | 2993590 | B2 | 10/1999 |
| JP | 2001-351712 | A | 12/2001 |
| JP | 2002-015803 | A | 1/2002 |
| JP | 2002-298964 | A | 10/2002 |
| JP | 2002-324624 | A | 11/2002 |
| JP | 2004-199934 | A | 7/2004 |
| JP | 2005-056792 | A | 3/2005 |
| JP | 2006-172877 | A | 6/2006 |

* cited by examiner

MALE TERMINAL HAVING A U-SHAPED CROSS SECTION

The present application is a divisional application of U.S. application Ser. No. 11/635,766, filed Dec. 8, 2006, which is based upon and claims the benefit of priority from Japanese Patent Application Nos. 2005-380303 and 2005-380304, the entire contents of all of which are incorporated herein by reference.

BACKGROUND OF THE INVENTION

1. Field of the Invention

The present invention relates to a connector structure having an electric terminal for flowing a large current, in more particularly, to a connector structure having a male terminal and a female terminal in that the male terminal is connected to the female terminal by inserting the male terminal into the female terminal.

2. Description of the Related Art

Nowadays, HEV (Hybrid Electric Vehicle) attracts a great deal of interest, since the HEV can provide an effect of reducing exhaust of harmful gas and a large fuel saving benefit. A connection between an inverter and a motor for driving the HEV is conducted by a connector, and a large current greater than 100 A may be flown in accordance with the system of the HEV. In accordance with development in electrical control techniques of the vehicles, a large number of connectors have been used for the vehicles. However, there are few kinds of connectors that are suitable for the large current flow. As examples of terminals used for the connectors suitable for the large current, a flat-plate shape male terminal shown in FIG. 11 and a flat-plate female terminal shown in FIG. 12 are proposed.

As shown in FIG. 11, a male terminal 50 composed of a single narrow plate member comprises a wire connecting portion 51 at one end thereof, to be connected to another electrical apparatus (not shown), and an inserting contact portion 52 at another end thereof, to be contact with a female terminal shown in FIG. 12. At the wire connecting portion 51, a device connecting hole 53 for fastening and tightening the male terminal 50 with a bolt to the other apparatus. Dimensions of the male terminal 50 are e.g. a width of about 95 mm and a thickness of about 1.2 mm.

As shown in FIG. 12, a female terminal 60 formed by bending a plate member comprises a terminal energizing portion 61 for fixing and electrically coupling the male terminal 50 thereto, and a wire clamping portion 62 for connecting an electric wire by clamping. In the terminal energizing portion 61, a plate spring 63 for fixing the male terminal 50 within the terminal energizing portion 61 is provided.

As shown in FIG. 13, when the male terminal 50 is inserted into the female terminal 60, the inserting contact portion 51 of the male terminal 50 is pressed by the plate spring 63 and attached securely into the terminal energizing portion 61, so that the male terminal 50 and the female terminal 60 are electrically connected with each other.

The male terminal 50 and the female terminal 60 shown in FIGS. 11 to 13 are made of a high conductivity material (i.e. a material having a high electrical conductivity), for example, copper. Among the copper materials, it is preferable to use the high conductivity copper material, so as to suppress generation of heat when the current is flown.

However, since a relationship between an electrical conductivity and strength of the terminal material is a trade-off, there is a tendency that the strength of the terminal is reduced when the high conductivity material is used for forming the terminal.

For example, if the terminal is formed by using a copper with a conductivity of 90% or more, a desired strength of the terminal cannot be obtained. Accordingly, it is necessary to form the terminal by using a material having a sufficient strength, while sacrificing the conductivity of the terminal material to some extent.

Since the female terminal 60 is provided with the spring 63, it is necessary to select the terminal material with considering that the spring 63 thus formed should have a sufficient elasticity, in addition to the relationship between the conductivity and the strength of the material.

The material having excellent characteristics for all of the conductivity, strength, and elasticity is not found currently. However, as the means for solving the above problems, there is proposed a female terminal with a configuration of combining a terminal energizing portion with a high conductivity and a spring with an excellent spring characteristic and a high strength, in which the spring and the terminal energizing portion are fabricated separately and combined with each other.

Conventional male terminal structures are disclosed by Japanese Patent No. 2878429 (JP-B-2878429), Japanese patent No. 2993590 (JP-B-2993590), and Japanese Utility Model publication for opposition No. 7-51739 (JP-Y-7-51739).

However, since the conventional male terminal 50 shown in FIG. 11 is composed of a single plate, a surface area there of is small, so that the heat dissipation property is not excellent. Accordingly, there is a disadvantage in that a temperature of the terminal is elevated during the large current flow, thereby influencing on a housing resin or peripheral devices of the connector.

Further, there is proposed a male terminal having a hollow structure with a rectangular cross section to increase a surface area and a cross sectional area of the male terminal, so as to enhance the heat dissipation property. However, in the case where the male terminal having the hollow and rectangular shape is used, while the heat dissipation during the current flow can be improved, it is difficult to conduct a bus connection which is typically used in the connection with a component at the device side such as an inverter. It is because that the terminal at the device side may be bent to have an L-shape when used for the bus connection in accordance with the system configuration. In such a case, it is significantly difficult to bend the terminal with the rectangular structure for the bus connection, since cracks may be generated. Therefore, the problems in the conventional male terminal cannot be solved by the hollow and rectangular structure male terminal. In addition, conventional female terminal structures are disclosed by Japanese Patent Laid-Open No. 11-233182 (JP-A-11-233182) and Japanese Patent Laid-Open No. 2005-56792 (JP-A-2005-56792).

However, when the conventional female terminal is used as a connector terminal for a vehicle, there is a following disadvantage. The connector terminal for a vehicle may be exposed to a high temperature such as 150° C. In such circumstances, a terminal box (terminal energizing portion 61) of the female terminal may be opened when a material composing the terminal has a large stress relaxation property. For example, a plate member bent with an angle of 90° may be deformed in an opposite direction as a result the plate member may be opened to have an angle of around 100°.

When the terminal box is opened, a distance between the spring and the terminal box is increased, namely, a space to which the male terminal is inserted is enlarged. In such a case, an amount of displacement applied to the spring is decreased, namely, a contacting force of the spring for pinching the male terminal is reduced, so that the electric apparatus connected via the female terminal 60 does not satisfy a predetermined characteristic.

Accordingly, it is necessary to form the female terminal in which the contacting force of the spring is set be high at a normal temperature, with considering an opening angle of the terminal box at the high temperature, such that the predetermined characteristic of the female terminal can be obtained even though the terminal box is opened due to the high temperature. However, when the spring with high contacting force is provided, there is a disadvantage in that a force required for inserting the male terminal into the female terminal (terminal inserting force) is increased, so that the insertion of the male terminal into the female terminal will be difficult.

SUMMARY OF THE INVENTION

Accordingly, an object of the invention is to provide a connector structure having a male terminal and a female terminal in which the male terminal has an excellent heat dissipation property during the large current flow and a good connection with an external device.

Another object of the invention is to provide a connector structure having a male terminal and a female terminal in which the female terminal is provided with a spring which keeps a good contacting force for fixing the male terminal at a high temperature, without increasing a terminal inserting force of the male terminal.

According to a first feature of the invention, a male terminal comprises:

a wire connecting portion at one end thereof, to be connected to an electric wire; and an inserting contact portion formed by bending a flat-plate member to have a U-shape cross section at another end, to be inserted into a female terminal.

In the male terminal, it is preferable that the inserting contact portion includes a bottom plate and projecting pieces projected from both sides of the bottom plate, and that a width of the bottom plate and a height of both of the projecting pieces are substantially same as those of an inner frame of the female terminal.

The male terminal may further comprise:

a stopper piece to be engaged with a housing of a connector accommodating the male terminal, the stopper piece being projected from a back end of an inserting portion of the projecting pieces.

In the male terminal, the inserting contact portion may comprise an inserting end portion having a tapered portion which is narrowed to its end.

According to a second feature of the invention, a female terminal comprises:

a terminal energizing portion composed of a high conductivity material having a frame structure, for accommodating a male terminal;

a terminal box composed of a material having a strength higher than that of the high conductivity material of the terminal energizing portion, for covering the terminal energizing portion; and a spring located within the terminal energizing portion for fixing the male terminal, the spring being formed integrally with the terminal box.

The female terminal may further comprise:

an opening formed at a surface of the terminal box, the opening being provided with a fixing tab for fixing the terminal energizing portion;

an engaging concave portion formed at a surface of the terminal energizing portion for engaging with the fixing tab, the surface of the terminal energizing portion contacting with the surface of the terminal box;

in which the terminal box and the terminal energizing portion are fixed with each other by bending the fixing tab into the engaging concave portion.

In the female terminal, it is preferable that each of the terminal box and the terminal energizing portion is formed by bending a single plate member to have a substantially rectangular cross section, a joint of the terminal energizing portion is located on a surface opposed to a surface on which a joint of the terminal box is located.

According to a third feature of the invention, a connector structure having a male terminal and a female terminal comprises:

the male terminal including:

a wire connecting portion at one end thereof, to be connected to an electric wire; and an inserting contact portion formed by bending a flat-plate member to have a U-shape cross section at another end, to be inserted into a female terminal; and the female terminal including:

a terminal energizing portion composed of a high conductivity material having a frame structure, for accommodating the male terminal;

a terminal box composed of a material having a strength higher than that of the high conductivity material of the terminal energizing portion, for covering the terminal energizing portion; and a spring located within the terminal energizing portion for fixing the male terminal, the spring being formed integrally with the terminal box.

According to the present invention, the male terminal can be provided with an excellent heat dissipation property during the large current flow and a good connection with an external device can be realized.

Further, according to the present invention, the female terminal can be provided with a spring which keeps a good contacting force for fixing the male terminal even at a high temperature, without increasing a terminal inserting force of the male terminal.

BRIEF DESCRIPTION OF THE DRAWINGS

Preferred embodiment according to the invention will be explained in conjunction with appended drawings, wherein:

FIGS. 4A and 4B are diagrams showing cross sections of the male terminals, wherein FIG. 4A is a cross sectional view of the male terminals disposed in parallel, and FIG. 4B is a cross sectional view of flat-plate shape male terminals disposed in parallel;

DETAILED DESCRIPTION OF THE PREFERRED EMBODIMENT

Next, a connector structure having a male terminal and a female terminal in the preferred embodiment according to the invention will be explained in more detailed in conjunction with the appended drawings.

Figure 1:
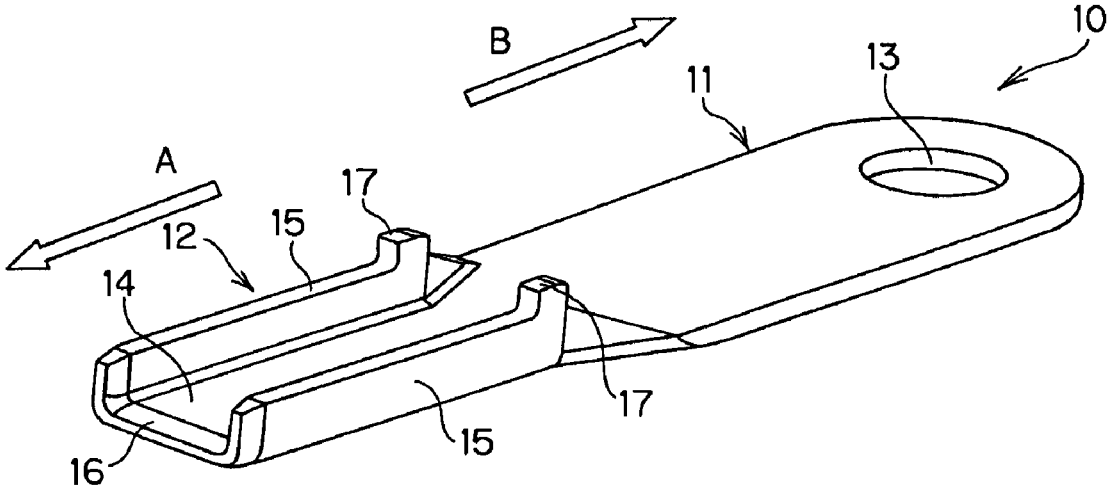
FIG. 1 is a perspective view showing a male terminal of a connector in a preferred embodiment according to the invention.

FIG. 1 is a perspective view showing a male terminal of a connector in the preferred embodiment according to the invention.

Figure 2:
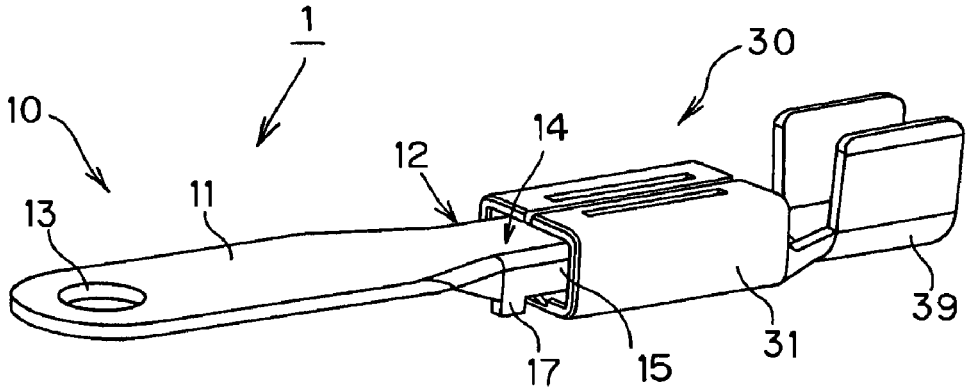
FIG. 2 is a perspective view showing a state where the male terminal of FIG. 1 is inserted into a female terminal.

FIG. 2 is a perspective view showing a connector 1 in which the male terminal 10 in the preferred embodiment is inserted into a female terminal 30.

In the preferred embodiment of the present invention, as shown in FIG. 1, a male terminal 10 composed of a narrow plate member comprises a wire connecting portion 11 at one end thereof (indicated by an arrow B), to be connected to an electric wire (of the other electrical apparatus), and an inserting contact portion 12 at another end thereof (indicated by an arrow A), to be inserted into the female terminal 30 shown in FIG. 2. In the preferred embodiment of the present invention, the inserting contact portion 12 of the male terminal 10 is formed of a flat-plate member and bent to have a U-shape cross section (namely, Japanese character "コ" shape) taken along a widthwise direction.

The wire connecting portion 11 and the inserting contact portion 12 are formed of a single plate member, and the wire connecting portion 11 is formed to have a flat-plate shape. The wire connecting portion 11 is provided with a device connecting hole 13 for electrically connecting the male terminal 10 to the other apparatus such as an inverter as well as for fastening and tightening the male terminal 10 with a bolt to the other apparatus. The inserting contact portion (U-shape portion) 12 formed at another end of the single plate comprises a bottom plate 14 to have a flat-plate shape similarly to the wire connecting portion 11, and projecting pieces 15, 15. Both of the projecting pieces 15, 15 are formed by bending both sides of the bottom plate 14 to be substantially perpendicular to the bottom plate 14.

Figure 12:
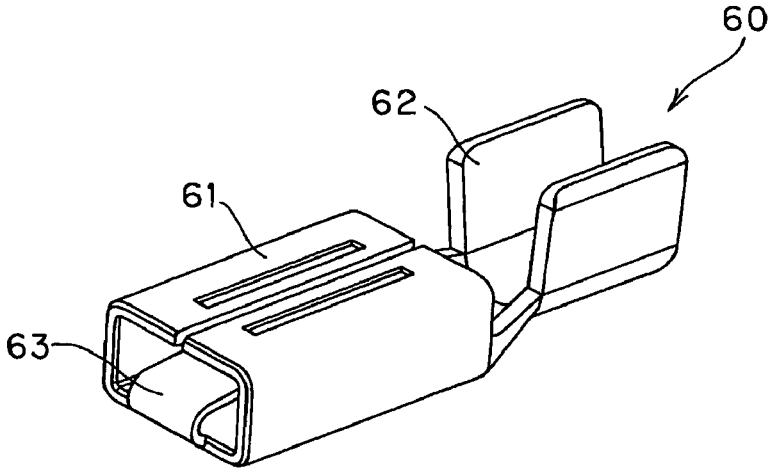
FIG. 12 PRIOR ART
FIG. 12 is a perspective view of a conventional female terminal.
Figure 13:
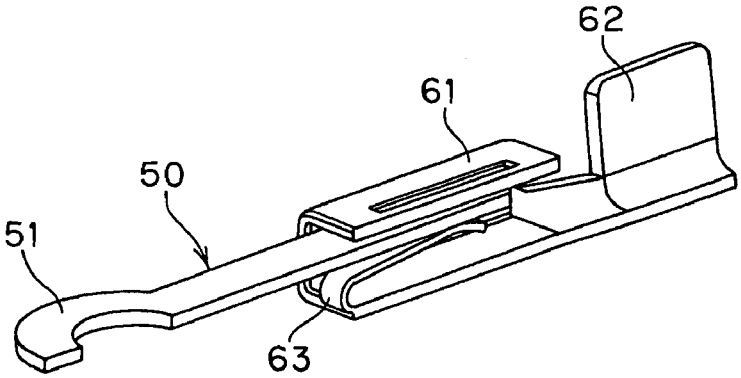
FIG. 13 PRIOR ART
FIG. 13 is a cross sectioned perspective view of a conventional connector in a state where the male terminal of FIG. 11 is inserted into the female terminal of FIG. 12.

An inserting end portion 16 of the inserting contact portion 12 is formed to have a tapered shape which is narrowed to its end. In concrete, a tip end of the bottom plate 14 and the both of projecting pieces 15, 15 are formed to have a tapered shape in a plate thickness direction. By forming the tip end of the inserting end portion 16 to be tapered, an inserting force of the male terminal 10 into the female terminal 30 can be reduced compared with the inserting force of the male terminal 50 into the female terminal 60 shown in FIG. 12.

In the inserting contact portion (U-shape portion) 12, it is preferable that a width of the bottom plate 14 is substantially same as a width of an inner frame of the female terminal 30, and that a height of both of the projecting pieces 15, 15 is substantially same as a height of the inner frame of the female terminal 30. By forming the width of the bottom plate 14 and the height of the projecting pieces 15, 15 substantially equal to the width and the height of the inner frame of the female terminal 30, respectively, looseness within the female terminal 30 can reduced, thereby fixing the male terminal 10 securely to the female terminal 30.

Stopper pieces 17, 17 to be engaged with a housing of a connector 1 for accommodating the male terminal 10 are formed to be projected from a back end of the projecting pieces 15, 15, i.e. at a wire connecting portion side of the inserting contact portion 12.

Figure 3:
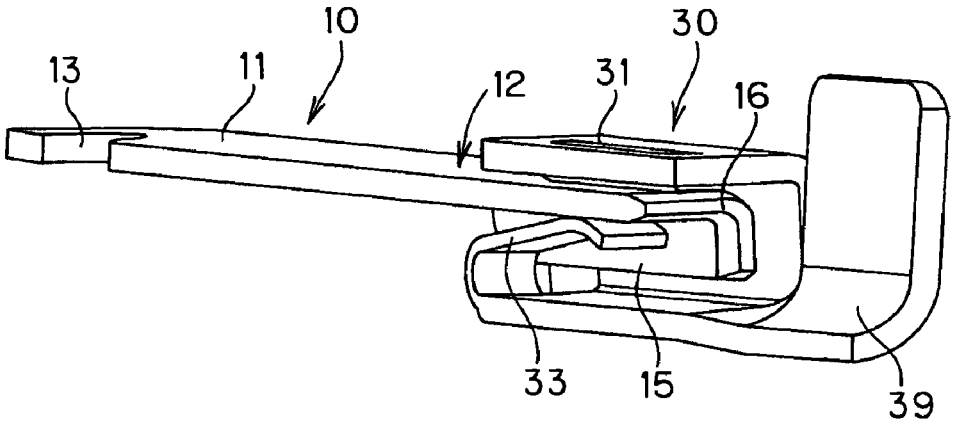
FIG. 3 is a cross sectioned perspective view showing the state where the male terminal of FIG. 1 is inserted into the female terminal.

FIGS. 2 and 3 are diagrams showing the state where the male terminal 10 in the preferred embodiment is inserted into the female terminal 30.

In FIGS. 2 and 3, the connector 1 comprises the male terminal 10 and the female terminal 30. The male terminal 10 comprises the wire connecting portion 11, the inserting contact portion 12, the device connecting hole 13, the bottom plate 14, the projecting piece 15, and the stopper piece 17, as described above. The female terminal 30 comprises a terminal energizing portion 31, a spring 33, and a wire clamping portion 39, and the configuration of the female terminal 30 will be explained later in conjunction with FIGS. 5 to 8.

As shown in FIGS. 2 and 3, the male terminal 10 is inserted into the terminal energizing portion 31 of the female terminal 30 such that the stopper piece 17 is located at a lower side of the male terminal 10, so that the bottom plate 14 is pinched and fixed by the terminal energizing portion 31 pressed by the spring 33.

According to the male terminal structure in this preferred embodiment, a cross section of the inserting contact portion 12 of the male terminal 10 is formed to have a U-shape, so that a cross sectional area and a surface area of the male terminal 10 can be increased compared with the flat-plate shape male terminal having the same width and thickness (plate thickness) as those of the male terminal 10. Accordingly, by increasing the cross sectional area of the male terminal 10, a resistance of the male terminal 10 can be reduced so that a heat generation during the current flow can be reduced. Further, by increasing the surface area of the male terminal 10, the heat dissipation property of the heat generated during the current flow can be enhanced. Accordingly, even though the large current is flown through the male terminal 10, a heat elevation of the male terminal 10 can be reduced, so that it is possible to suppress the damages of the housing resin of the connector 1 provided with the male terminal 10 and the influences on the peripheral devices of the male terminal 10.

Figure 4A:
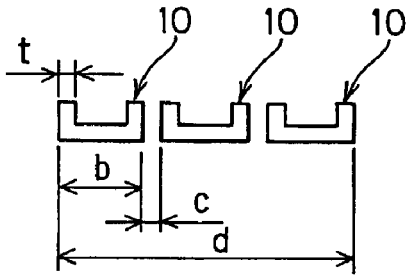
Figure 4B:
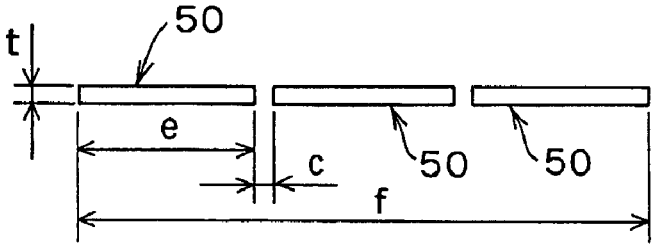

The male terminal 10 is used, for example, for the connection between the motor of the HEV and the inverter, and the wire connecting portion 11 of the male terminal 10 is connected to an inverter side. At this time, as shown in FIG. 4A, since a three phase current is flown between the inverter and the motor, three terminals are disposed in parallel. In this preferred embodiment, since the inserting contact portion 12 of the male terminal 10 has the U-shape cross section, a distance (d) in a terminal width direction can be shortened, compared with a distance (f) in a terminal width direction of three male terminals 50 disposed in parallel shown in FIG. 4B, i.e. $d<f$. Herein, each of the male terminals 50 having a flat-plate cross section has a thickness (t) which is same as a thickness of the male terminal 10. It is because that a terminal width (b) of the male terminal 10 is shorter than a terminal width (e) of the male terminal 50 having a flat plate shape and the same cross sectional area as that of the male terminal 10, i.e. b<e. When the three male terminals 10 are disposed in parallel, a sum of the terminal width (b) of the male terminals 10 and a distance (c) between the male terminals 10 is reduced, compared with the case where three flat-plate shaped male terminals 50 are disposed in parallel. Accordingly, by decreasing the terminal width (b), the large current connector comprising the three male terminals 10 disposed in parallel can be miniaturized.

If the flat-plate shaped male terminal 50 is formed to have a terminal width equal to that of the male terminal 10 and a terminal thickness greater than that of the male terminal 10, a cross sectional area of the flat-plate shaped male terminal 50 may be equal to that of the male terminal 10. However, in this case, the thickness of the flat-plate shaped male terminal 50 is significantly increased. In typical male terminals, a terminal surface is generally coated by a plating to prevent generation of an oxide film on the terminal surface to obtain a stable electrical contact. However, it is difficult to coat the male terminal composed of a thick plate member with the plating. For example, if the flat-plate shaped male terminal 50 is formed to have a width of 13 mm and a cross sectional area of 31.2 $mm^2$ that are equal to those of the male terminal 10, a thickness of the male terminal (plate member) 50 will be 2.4 mm. According to the current technology, it is significantly difficult to provide the plate member of 2.4 mm with the plating. The male terminal 10 according to this preferred embodiment is formed to have a narrow width by using a thin plate member, so that it is possible to provide the male terminal 10 with the plating for preventing the generation of the oxide film.

Further, in the male terminal 10, since the wire contacting portion 13 is formed to have a flat-plate shape, the bending process can be easily conducted for the wire contacting portion 13. For example, even if the male terminal 10 is formed to have the L-shape in accordance with a position of the device to be connected to the male terminal 10, the wire contacting portion 13 can be easily applied thereto.

Next, the female terminal 30 to which the male terminal 10 in this preferred embodiment is inserted will be explained in more detail.

As shown in FIGS. 5 to 8, the female terminal 30 comprises the terminal energizing portion 31 composed of a high conductivity material having a frame structure, for accommodating the male terminal 10, i.e. into which the male terminal 10 is inserted, and the spring 33 located within the terminal energizing portion 31 for fixing the male terminal 10 to be inserted. The female terminal 30 further comprises a terminal box 32 composed of a material having strength higher than that of the high conductivity material of the terminal energizing portion 31, for covering the terminal energizing portion 31, and the spring 33 is formed integrally with the terminal box 32.

The terminal energizing portion 31 is formed to have a substantially rectangular cross section, and the terminal box 32 is also formed to have a substantially rectangular cross section, such that the terminal box 32 fits with the terminal energizing portion 31. A part of a surface 34 (an upper surface in FIGS. 5 to 8) of the terminal box 32 is formed to extend from a male terminal insertion side to an inside of the terminal energizing portion 31, and a part of an extended portion of the terminal box 32 is bent into the terminal energizing portion 31, so that the spring 33 is formed to be a plate spring. The spring 33 is construed to contact with a convex portion 35 that is formed at a bottom surface (a lower surface in FIGS. 5 to 8) of the terminal energizing portion 31, and the male terminal 10 inserted from the male terminal insertion side is pinched by the spring 33 and the convex portion 35, so that the male terminal 10 is fixed in the terminal energizing portion 31.

An opening 36 is formed at the upper surface 34 of the terminal box 32. The opening 36 is provided with fixing tabs 37, 37 for fixing the terminal energizing portion 31. On the other hand, a surface (an upper surface in FIGS. 5 to 8) of the terminal energizing portion 31 is provided with engaging concave portions 38, 38 for engaging with the fixing tabs 37, 37, respectively. The upper surface of the terminal energizing portion 31 contacts with the upper surface 34 of the terminal box 32 on which the opening 36 is provided. In the female terminal 30, the fixing tab 37 engages with the engaging concave portion 38 by bending the fixing tab 37 into the engaging concave portion 38 to a terminal energizing portion side, namely, to an inside of the female terminal 30, so that the terminal box 32 and the terminal energizing portion 31 are fixed with each other.

According to this structure, the terminal energizing portion 31 and the terminal box 32, that are composed of different metal plate members, are always fixed at a constant position, so that it is possible to construe the female terminal 30 in which the terminal energizing portion 31 does not fall out from the terminal box 32 and is stably fixed to the terminal box 32.

The terminal energizing portion 31 is formed by bending a plate member composed of a high conductivity material, and formed integrally with the wire clamping portion 39. The wiring clamping portion 39 is composed of a high conductivity material for fixing the electric wire to the female terminal 30 by clamping the electric wire.

The terminal box 32 is formed by bending a single plate member to have a substantially rectangular cross section, a joint 42 is located on a surface (a lower surface in FIGS. 5 to 8) 41 opposed to the upper surface 34 on which the opening 36 is formed. The terminal energizing portion 31 is formed by bending a single plate member to have a substantially rectangular cross section, a joint 43 of the terminal energizing portion 31 is located on a surface (an upper surface in FIGS. 5 to 8) opposed to a surface 41 on which the joint 43 of the terminal box 32 is located.

The joint 43 of the terminal energizing portion 31 and the joint 42 of the terminal box 32 are positioned to be facing to each other, and the terminal energizing portion 31 is fitted and fixed into the terminal box 32, so that the terminal energizing portion 31 is strong against a wrenching force applied from inside of the terminal energizing portion 31 when the male terminal 10 is inserted into the terminal energizing portion 31.

Since the conventional female terminal 60 consists of the terminal energizing portion 61 composed of a single plate member, in a case where the terminal energizing portion 61 has a joint, the terminal energizing portion 61 is deformed from the joint when the wrenching force is applied to the terminal energizing portion 61 due to the insertion of the male terminal into the terminal energizing portion 61. Namely, due to the wrenching force applied to the terminal energizing portion 61, the plate members are separated from each other at the joint, so that the frame structure cannot be maintained. Therefore, according to the female terminal structure in this preferred embodiment, the frame structure can be maintained by locating the joints at the opposed surfaces.

As the high conductivity material composing the terminal energizing portion 31 and the wire clamping portion 39, it is preferable to use a material with a conductivity of 60% IACS or more, and more preferably a material with a conductivity of 93% IACS or more.

In this preferred embodiment, as the high conductivity material, oxygen-free copper with a conductivity of 97% IACS is used. The terminal box 32 is formed by using SUS which is excellent in stress relaxing characteristic.

Figure 9:
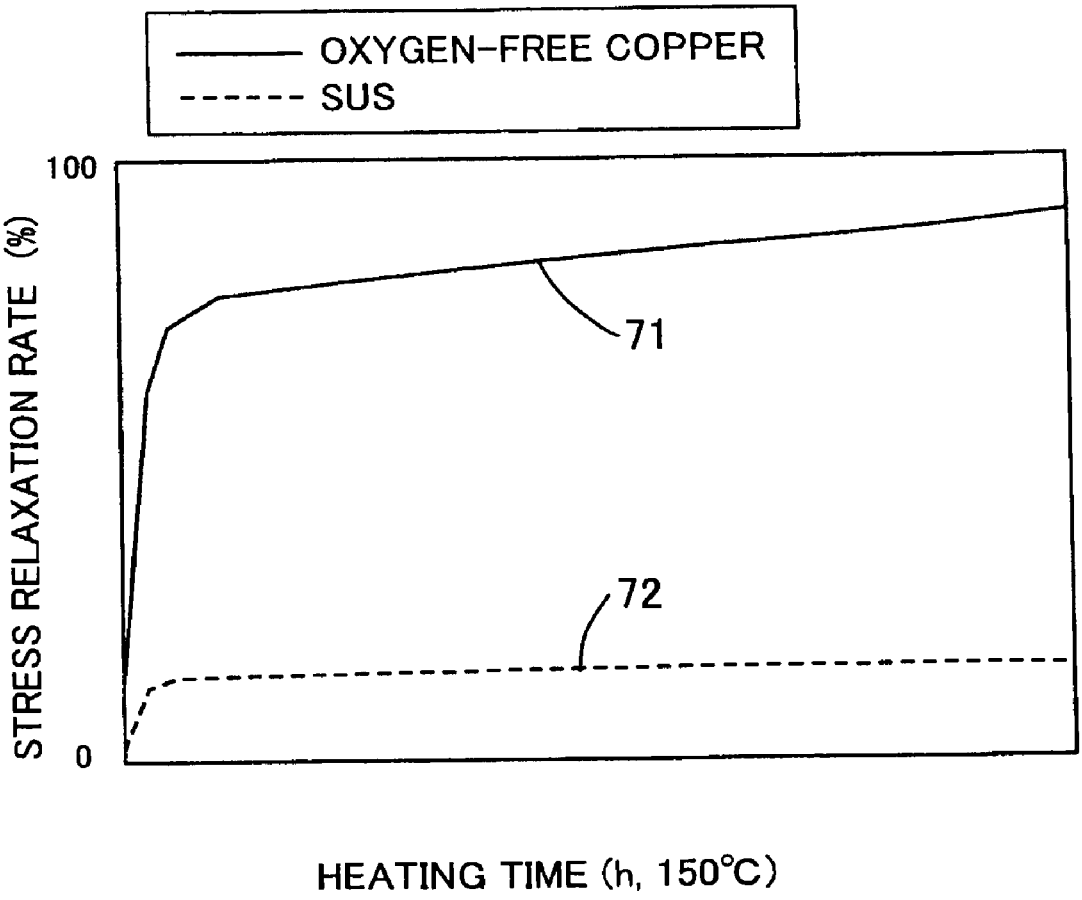
FIG. 9 is a graph showing stress relaxing characteristics of an oxygen-free copper and a SUS.

Next, FIG. 9 is a graph showing respective stress relaxing characteristics of oxygen-free copper and SUS. The respective stress relaxing characteristics shown in FIG. 9 are stress relaxation rates varied by a heating temperature of a SUS plate member and an oxygen-free copper plate member, that are measured by exposing the SUS plate member and the oxygen-free copper plate member in an environment heated at a temperature of 150° C.

As shown in FIG. 9, a characteristic line 71 of the oxygen-free copper indicates that the stress relaxation rate of the oxygen-free copper is immediately elevated when the oxygen-free copper is kept at the temperature of 150° C., while a characteristic line 72 of the SUS indicates that the stress relaxation rate of the SUS does not substantially change even though the SUS is kept at the temperature of 150° C. Accordingly, it is understood from the graph of FIG. 9 that a shape of the terminal box 32 made of SUS hardly changes at the high temperature (150° C.).

According to the female structure in this preferred embodiment, the terminal box 32 composed of SUS material with a small stress relaxing characteristic is provided, so as to cover the terminal energizing portion 31 composed of the high conductivity material. A portion of the terminal box 32 bent with an angle of 90° is not opened further, so that the terminal box 32 can keep its shape with the substantially rectangular cross section without deforming even though the female terminal 30 is exposed in the environment of the high temperature. Accordingly, the spring 33 integrally formed with the terminal box 32 is not shifted from the terminal energizing portion 31, namely a force of pressing the terminal energizing portion 31 is not reduced, so that a contacting force of the male terminal 10 given by the spring 33 can be kept.

In other words, the female terminal 30 in this preferred embodiment has the terminal energizing portion 31 composed of the high conductivity material, thereby reducing the heat generated by the large current flow. In addition, the terminal energizing portion 31 is covered with the terminal box 32, and the spring 33 is formed integrally with the terminal box 32, thereby keeping a stable large current flow.

Further, since it is not necessary to design the connector structure with considering a deterioration in elasticity of the spring 33 at the high temperature, the contacting force can be decreased, so that the force required to insert the male terminal 10 into the female terminal 60 (terminal insertion force) can be reduced.

Figure 5:
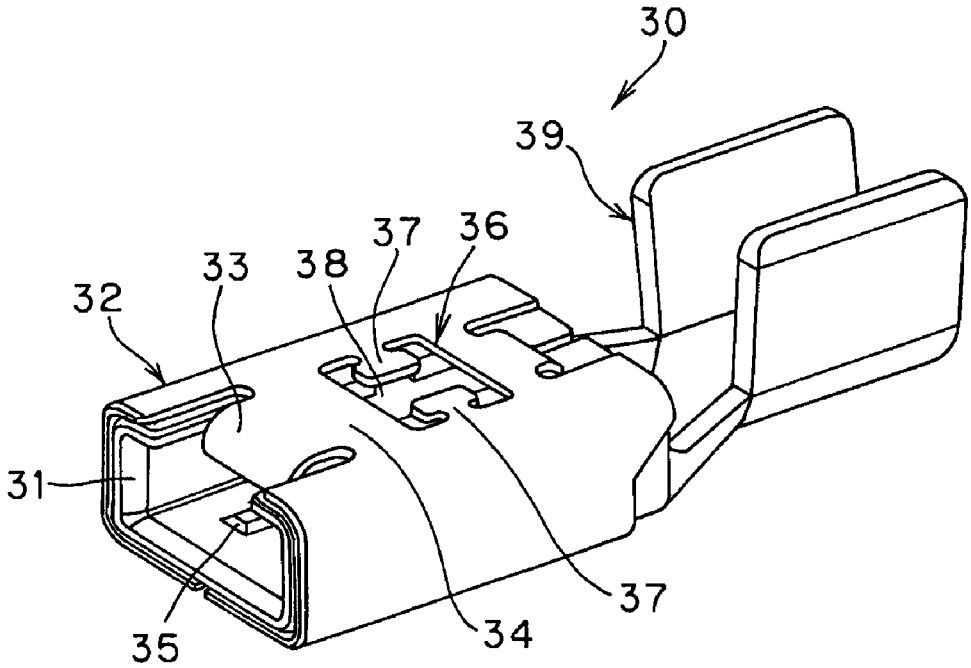
FIG. 5 is a perspective view of a female terminal in the preferred embodiment according to the invention.
Figure 6:
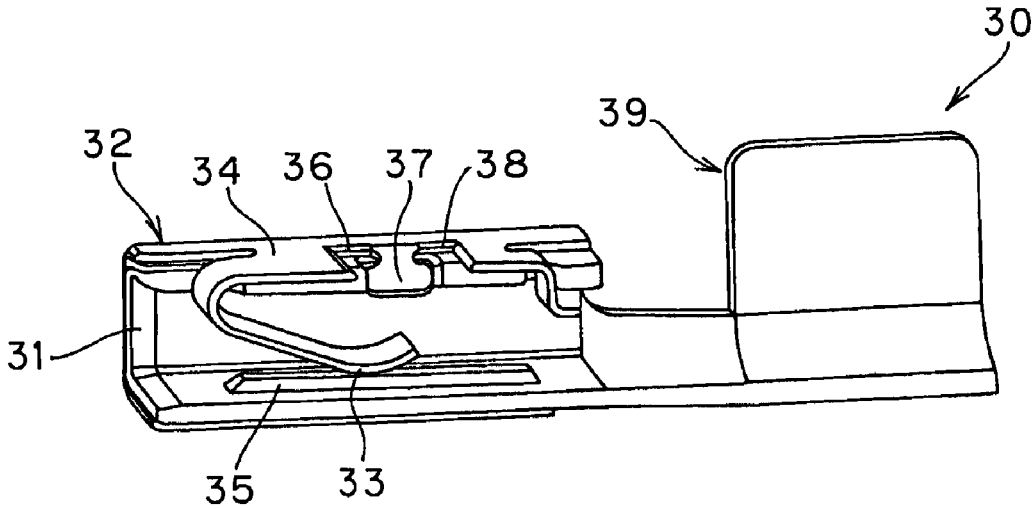
FIG. 6 is a cross sectioned perspective view of the female terminal of FIG. 5 taken along a longitudinal direction.
Figure 7:
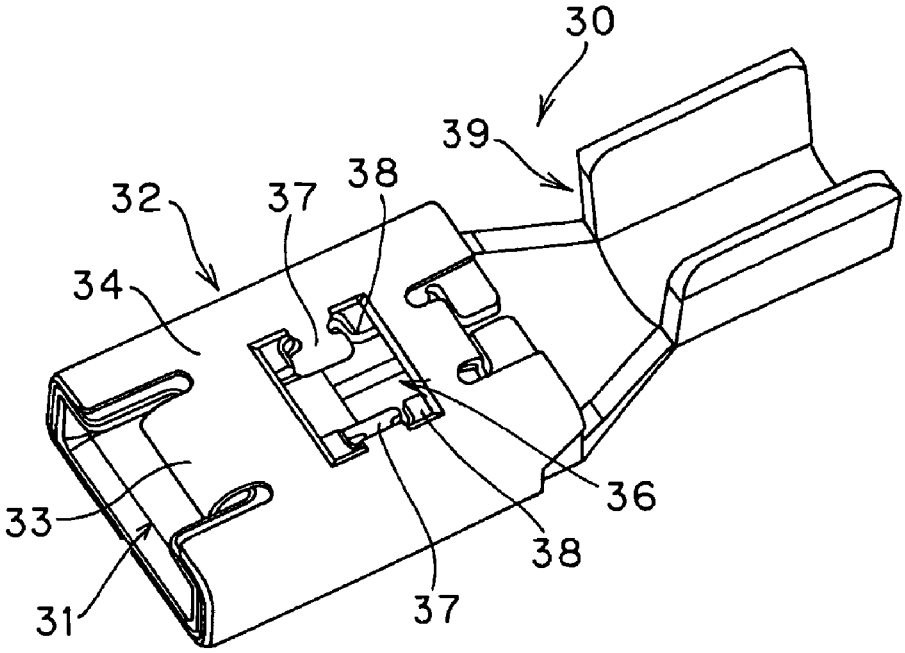
FIG. 7 is a perspective view of the female terminal of FIG. 5 viewed from an upper side.
Figure 8:
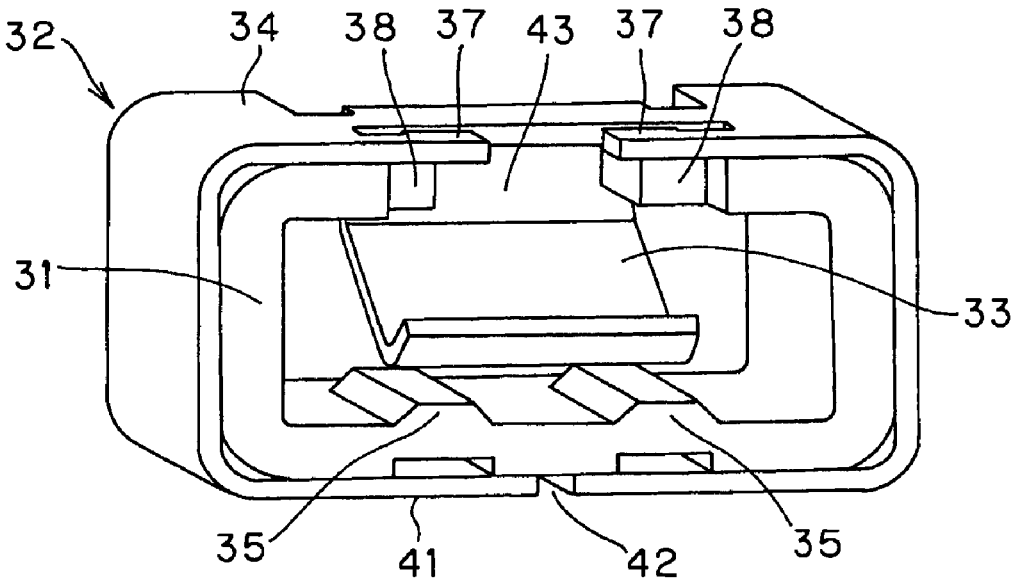
FIG. 8 is a perspective view of the female terminal of FIG. 5 taken along a widthwise direction.
Figure 10:
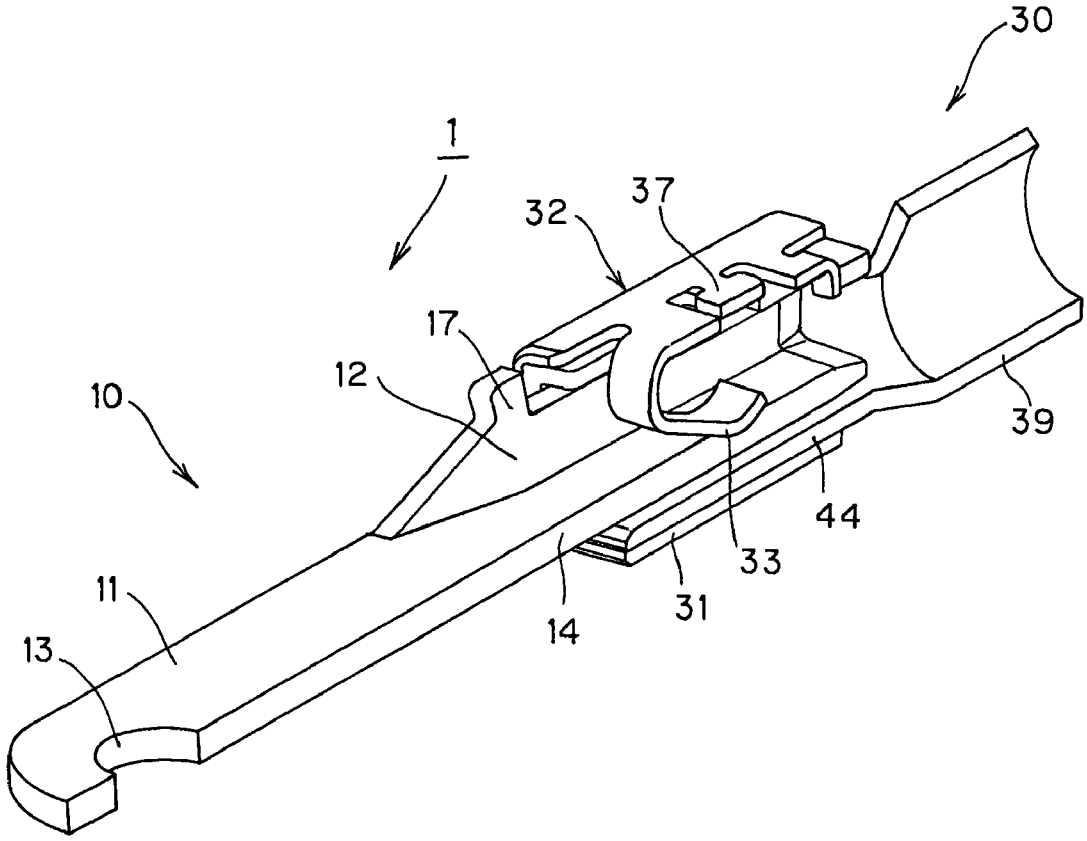
FIG. 10 is a cross sectioned perspective view of the connector in a state where the male terminal of FIG. 1 is inserted into the female terminal of FIG. 5.
Figure 11:
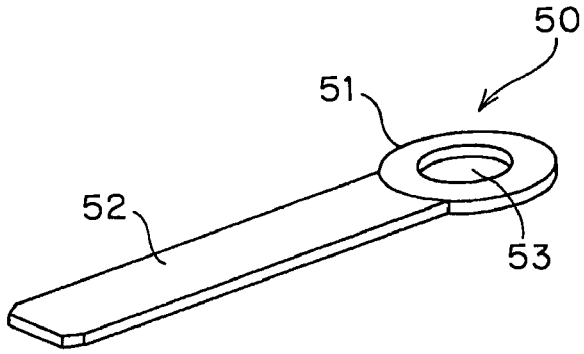
FIG. 11 PRIOR ART
FIG. 11 is a perspective view of a conventional male terminal.

FIG. 10 is a cross sectioned perspective view of the connector 1 in a state where the male terminal 10 of FIG. 1 is inserted into the female terminal 30 of FIG. 5. As shown in FIG. 10, the inserting contact portion 12 of the male terminal 10 is inserted into the terminal energizing portion 31 of the female terminal 30, and the inserting contact portion 12 is fixed by the spring 33 to a bottom surface 44 of the terminal energizing portion 31. In more concrete, a bottom plate 14 is fixed by the spring 33 of the female terminal 30. The male terminal 10 is accommodated in the housing of the connector 1 and the stopper piece 17 is engaged with and fixed to the connector housing (not shown).

According to the terminal connector structure in which the male terminal 10 is inserted into the female terminal 30 in this preferred embodiment, the heat dissipation property is enhanced and the contacting force between the terminals can be kept even in the environment with the high temperature, so that the stable electrical connection can be realized.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A male terminal, comprising:

a wire connecting portion at one end thereof, wherein the wire connecting portion is configured to be connected to an electric wire; and an inserting contact portion formed by bending a flat-plate member to have a one-side opened rectangular cross section at another end, to be inserted into a female terminal, the inserting contact portion comprising a bottom plate and projecting pieces projected from both sides of the bottom plate;

wherein an upper face of the inserting contact portion is open at the another end;

wherein the male terminal includes an opening configured to accommodate a spring portion of the female terminal;

wherein the bottom plate of the male terminal is configured to contact the spring portion of the female terminal inside of the male terminal.

2. The male terminal, according to claim 1, wherein a width of the bottom plate and a height of both of the projecting pieces are substantially the same as those of an inner frame of the female terminal.

3. The male terminal, according to claim 2, further comprising:

a stopper piece configured to be engaged with a housing of a connector accommodating the male terminal, the stopper piece being projected from a back end of an inserting portion of the projecting pieces.

4. The male terminal, according to claim 1, wherein the inserting contact portion comprises an inserting end portion having a tapered portion which is narrowed to its end.

5. The male terminal, according to claim 1, wherein the upper face is located on a long side of the rectangular cross section of the inserting contact portion.

6. The male terminal, according to claim 2, wherein the upper face is located on a long side of the rectangular cross section of the inserting contact portion.

7. The male terminal, according to claim 1, wherein the projecting pieces are arranged vertically to the bottom plate.

8. The male terminal, according to claim 1, wherein a cross section of the inserting contact portion is symmetrical.

9. The male terminal, according to claim 1, wherein both of the projecting pieces have a flat shape.

10. The male terminal, according to claim 1, wherein the open end extends along a length of the inserting contact portion.

11. The male terminal according to claim 1, wherein the inserting contact portion has a U-shaped cross-section formed by the bottom plate and the projecting pieces.

12. The male terminal according to claim 11, wherein the wire connecting portion is formed by a single flat plate.

13. The male terminal according to claim 1, wherein the wire connecting portion and the inserting contact portion are formed by a single plate member.

14. The male terminal according to claim 1, wherein the inserting contact portion is configured to receive the spring portion of the female terminal between the projecting pieces when the male terminal is inserted into the female terminal.

15. A male terminal, comprising:

a wire connecting portion at one end thereof, wherein the wire connecting portion is configured to be connected to an electric wire; and an inserting contact portion formed by bending a flat-plate member to have a one-side opened rectangular cross section at another end, to be inserted into a female terminal, the inserting contact portion comprising a bottom plate and projecting pieces projected from both sides of the bottom plate;

wherein an upper face of the inserting contact portion is open at the another end;

wherein the male terminal is configured to engage with the female terminal comprising a terminal energizing portion comprising a high conductivity material comprising a frame structure for accommodating the male terminal, and a spring portion provided in the terminal energizing portion, wherein the male terminal is configured such that when the male terminal is inserted into the female terminal the spring portion presses the male terminal to the terminal energizing portion of the female terminal.

16. The male terminal according to claim 15, wherein the male terminal is configured such that when the male terminal is inserted into the female terminal the spring portion of the female terminal is located between the projecting pieces of the male terminal.

17. The male terminal according to claim 15, wherein the inserting contact portion has a U-shaped cross-section formed by the bottom plate and the projecting pieces.

* * * * *